US007546798B2

(12) United States Patent
Naidu et al.

(10) Patent No.: US 7,546,798 B2
(45) Date of Patent: Jun. 16, 2009

(54) WRINGING DEVICE

(75) Inventors: Vishnu R. Naidu, Windermere, FL (US); Joseph R. Russo, Jr., Orlando, FL (US)

(73) Assignee: Chep Technology Pty Limited, Sydney (AU)

( * ) Notice: Subject to any disclaimer, the term of this patent is extended or adjusted under 35 U.S.C. 154(b) by 0 days.

(21) Appl. No.: 12/233,164

(22) Filed: Sep. 18, 2008

(65) Prior Publication Data

US 2009/0013883 A1 Jan. 15, 2009

Related U.S. Application Data

(62) Division of application No. 11/263,231, filed on Oct. 31, 2005, now Pat. No. 7,441,497.

(51) Int. Cl.
*B30B 9/20* (2006.01)
*B30B 13/00* (2006.01)

(52) U.S. Cl. ..... 100/37; 100/76; 100/121

(58) Field of Classification Search ..... 100/36, 100/37, 76, 100, 121, 122, 155 R, 163 R, 100/168, 169, 170, 172, 176; 15/260, 262; 68/97, 98, 99, 241, 244, 248, 250, 255, 253 R, 68/257, 258; 210/770
See application file for complete search history.

(56) References Cited

U.S. PATENT DOCUMENTS

| | | | | |
|---|---|---|---|---|
| 140,344 A | | 7/1873 | Brooks et al. | 68/244 |
| 597,602 A | | 1/1898 | Budd | 68/244 |
| 731,356 A | | 6/1903 | Gray | 68/99 |
| 1,130,879 A | * | 3/1915 | Berrigan | 100/36 |
| 2,068,525 A | | 1/1937 | Williams | 68/248 |
| 2,964,825 A | | 12/1960 | Cocker | 28/183 |
| 3,370,528 A | | 2/1968 | Schneider | 100/173 |
| 5,370,795 A | | 12/1994 | DeHaan et al. | 210/255 |
| 5,916,276 A | | 6/1999 | Walker | 68/247 |
| 6,146,540 A | * | 11/2000 | Nakamura et al. | 210/745 |
| 7,441,497 B2 | * | 10/2008 | Naidu et al. | 100/121 |

FOREIGN PATENT DOCUMENTS

| | | | |
|---|---|---|---|
| JP | 58116996 | 7/1983 | 100/145 |

* cited by examiner

*Primary Examiner*—Jimmy T Nguyen
(74) *Attorney, Agent, or Firm*—Allen, Dyer, Doppelt, Milbrath & Gilchrist, P.A.

(57) ABSTRACT

A method for wringing fluids from a flexible container positioned within a rigid structure is based on the use of a wringing device. The wringing device includes a sup ort frame having a pair of spaced apart side supports, at least one rotatable take-up shaft extending between the pair of spaced apart side supports, and a carriage coupled to the support frame. The carriage includes a pair of spaced apart side members, a nip shaft extending between the pair of spaced apart side members, and a movable nip shaft adjacent the nip shaft and also extending between the air of spaced apart side members. The method includes passing the flexible container between the nip shaft and the movable nip shaft, and securing the flexible container to the at least one take-up shaft. The at least one take-up shaft is rotated for wrapping the flexible container therearound after having passed between the nip shaft and the moveable nip shaft so that the fluids are wringed out of the flexible container.

16 Claims, 6 Drawing Sheets

WRINGING DEVICE

RELATED APPLICATION

This is a divisional patent application of U.S. patent application Ser. No. 11/263,231 filed Oct. 31, 2005 U.S. Pat. No. 7,441,497 issued Oct. 28, 2008, the entire disclosure of which is incorporated herein by reference.

FIELD OF THE INVENTION

This invention is directed generally to wringing devices, and more particularly to devices usable for wringing fluids from flexible containers.

BACKGROUND

Fluids and other viscous materials are typically shipped using a variety of shipping containers, such as, drums, tanks, intermediate bulk containers, and others. Intermediate bulk containers are often formed from an external frame configured to support an internal, flexible bladder. The intermediate bulk containers include an inlet fitment on an upper surface of the bladder to fill the bladder and include an exhaust fitment in a lower corner of the flexible bladder to drain the bladder. Intermediate bulk containers are typically drained via gravity or pumps and typically without other assistance. While low viscosity fluids may be easily drained from the bladder, high viscosity materials are difficult to drain from the bladders. Gravity is often not sufficient to drain high viscosity materials. Pumps have also been problematic. In particular, pumps often cavitate and lose prime when attempting to pump high viscosity materials. In addition, pumps often create voids in the bladder that hampers fluid flow within the bladder. Conventional systems are also typically fiscally inefficient because conventional systems often leave about two percent of the fluids in the bladder. Thus, a need exists for more economical and efficient device for removing materials from a flexible bladder.

SUMMARY OF THE INVENTION

This invention relates to a wringing device configured to expel materials from a flexible container. In particular, the wringing device may be configured to expel materials such as, but not limited to, fluids contained within flexible containers by applying forces to the flexible containers. The flexible containers may be contained within rigid support structures, such as, but not limited to, conventional intermediate bulk containers (IBCs) and other appropriate devices. The wringing device may be formed from a support frame and a carriage movably coupled to the support frame for supporting components of the wringing device. The carriage may be formed from a first side support, a second side support positioned generally opposite from the first side support, and at least one cross member extending between the first side support and the second side support. The wringing device may include a nip shaft coupled to the carriage and a movable nip shaft movably coupled to the carriage proximate to the nip shaft. The movable nip shaft may be biased toward the nip shaft with a biasing device. The movable nip shaft may be movably attached to the carriage with a pair of pivot arms coupled to the first and second side supports. The movable nip shaft may be rotated away from the nip shaft to enable a flexible container to be passed between the movable nip shaft and the nip shaft. The wringing device may include a take-up shaft for collecting a flexible container.

The wringing device may include a wringing device transport system for moving the wringing device into position on an upper surface of a bulk container. The wringing device may include a support structure drive device for moving the wringing device into position. The support structure drive device may include one or more motors. The wringing device transport system may also be formed from a plurality of wheels configured and positioned to mate with upper surfaces of the bulk container.

The wringing device may include a carriage drive device configured to control movement of the carriage relative to the support frame. The wringing device may also include a take-up shaft drive device for controlling the take-up shaft. The take-up shaft drive device may be include a motor, such as, but not limited to, a compressed air motor configured to slip at a predetermined upper threshold torque to limit, if not eliminate, the risk of the flexible container ripping open. In at least one embodiment, the take-up shaft drive device, the carriage drive device, and the support structure drive device may be controlled with a drive motor controller.

The wringing device may also include a transport vehicle for transporting the wringing device. The transport vehicle may include a height that is sufficient to transfer the wringing device from the transport vehicle to an upper surface of a bulk container.

The wringing device may be used to facilitate delivery of materials from a flexible container. The wringing device may be moved into position using the transport vehicle. In particular, the wringing device transport system may be placed in alignment with an upper surface of the bulk container so that the support frame of the wringing device may be moved from the transport vehicle to the upper surface of the bulk container. The wringing device transport system may be actuated to move the support frame of the wringing device onto the bulk container. The biasing device may be moved with the lever to separate the movable nip shaft from the nip shaft. An upper portion of the flexible container may be feed between the movable nip shaft and the nip shaft and coupled to the tale-up shaft. The take-up shaft may be rotated with the take-up shaft drive device to wrap the flexible container around the take-up shaft, thereby causing the material contained within the flexible container to be expelled through one or more fitments.

An advantage of this invention is that the wringing device enables materials, including high viscosity materials, to be removed from a flexible container while leaving only about 0.5 percent in the flexible container. Conventional systems typically leave about two percent of the material in the flexible container.

Another advantage of this invention is that wringing device provides a constant flow of materials from the flexible container, if desired.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 4:
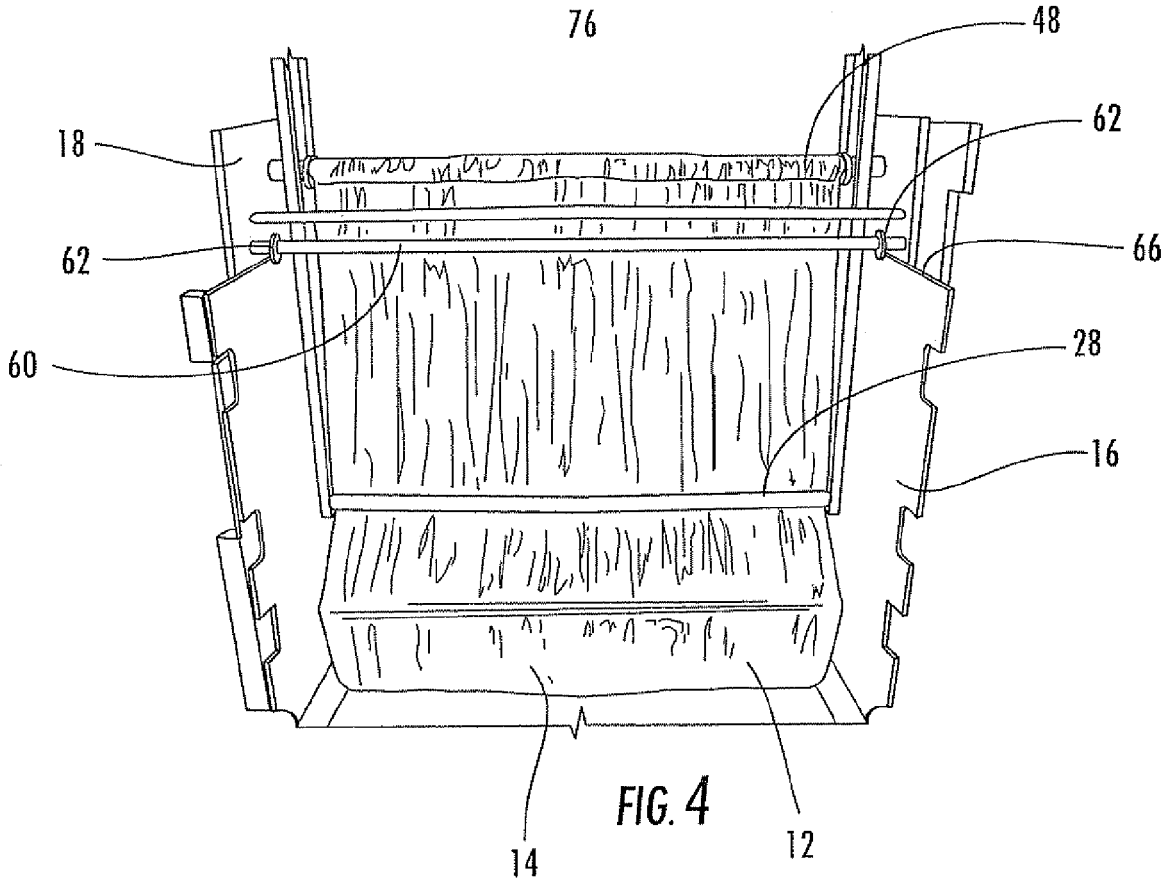
FIG. 4 is a perspective view of the wringing device in use expelling fluids from the flexible bladder.

As shown in FIGS. 1-7, this invention is directed to a wringing device 10 configured to expel materials from a flexible container 14. In particular, as shown in FIG. 4, the wringing device 10 may be configured to expel materials 12, such as, but not limited to fluids, contained within flexible containers 14 by applying forces to the flexible containers 14. The flexible containers 14 may be contained within rigid support structures 16, such as but not limited to, conventional intermediate bulk containers (IBCs) and other appropriate devices.

Figure 1:
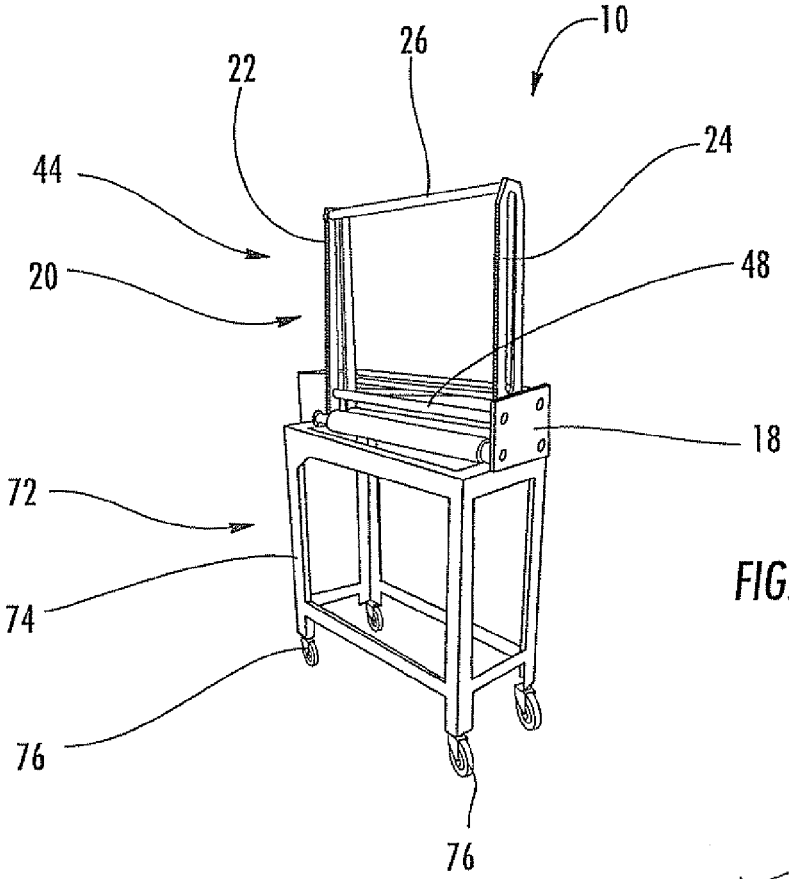
FIG. 1 is a perspective view of a wringing device having aspects of the invention.
Figure 3:
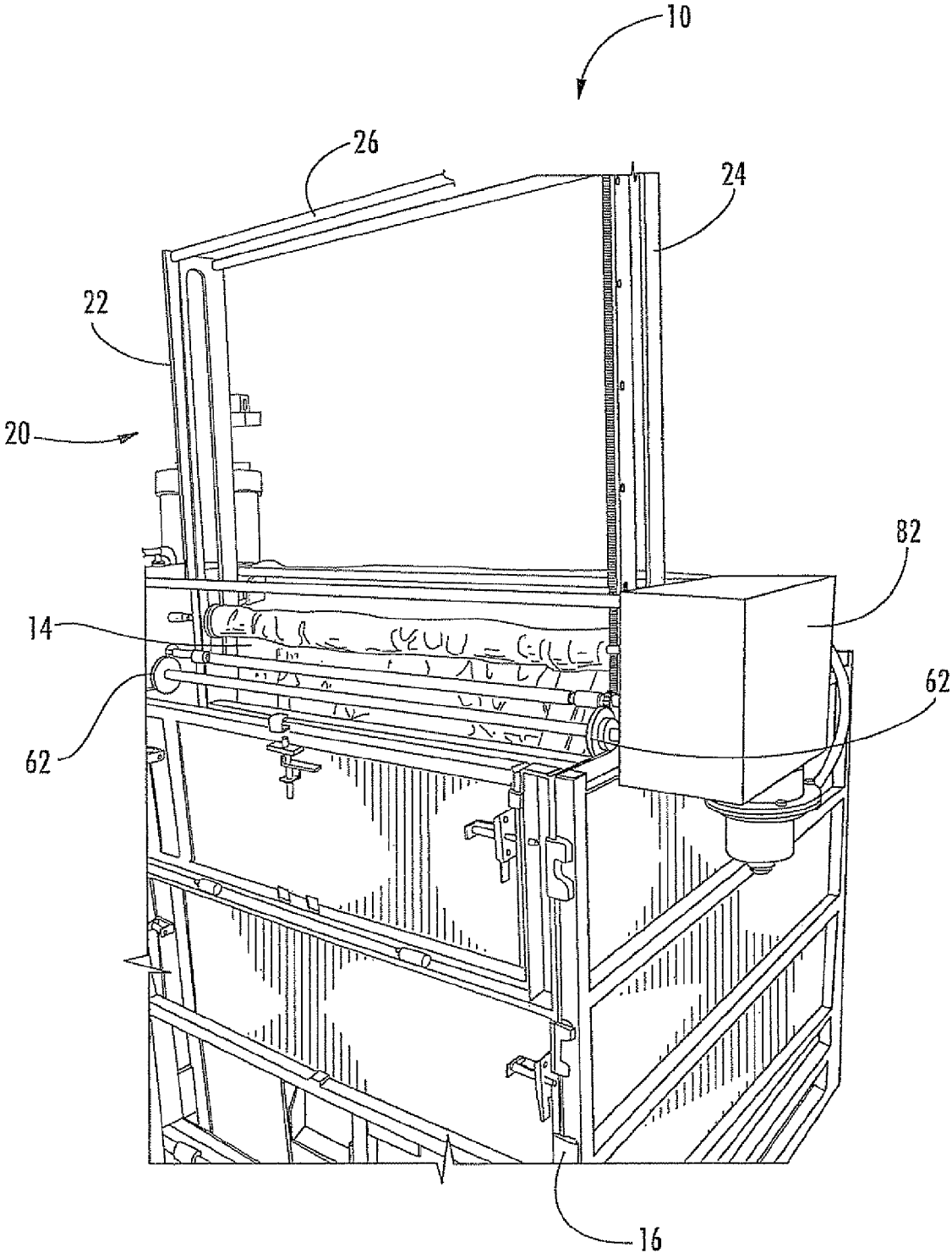
FIG. 3 is a perspective view of the wringing device positioned on an intermediate bulk container.

As shown in FIG. 1, the wringing device 10 may be formed from a support frame 18 figured to support components of the wringing device 10. The support frame 18 may be configured to support the wringing device 10 while the wringing device 10 is positioned on top of a bulk container, as shown in FIG. 3. The support frame 18 may be formed from any appropriate materials having substantial rigidity to support components of the wringing device 10.

Figure 5:
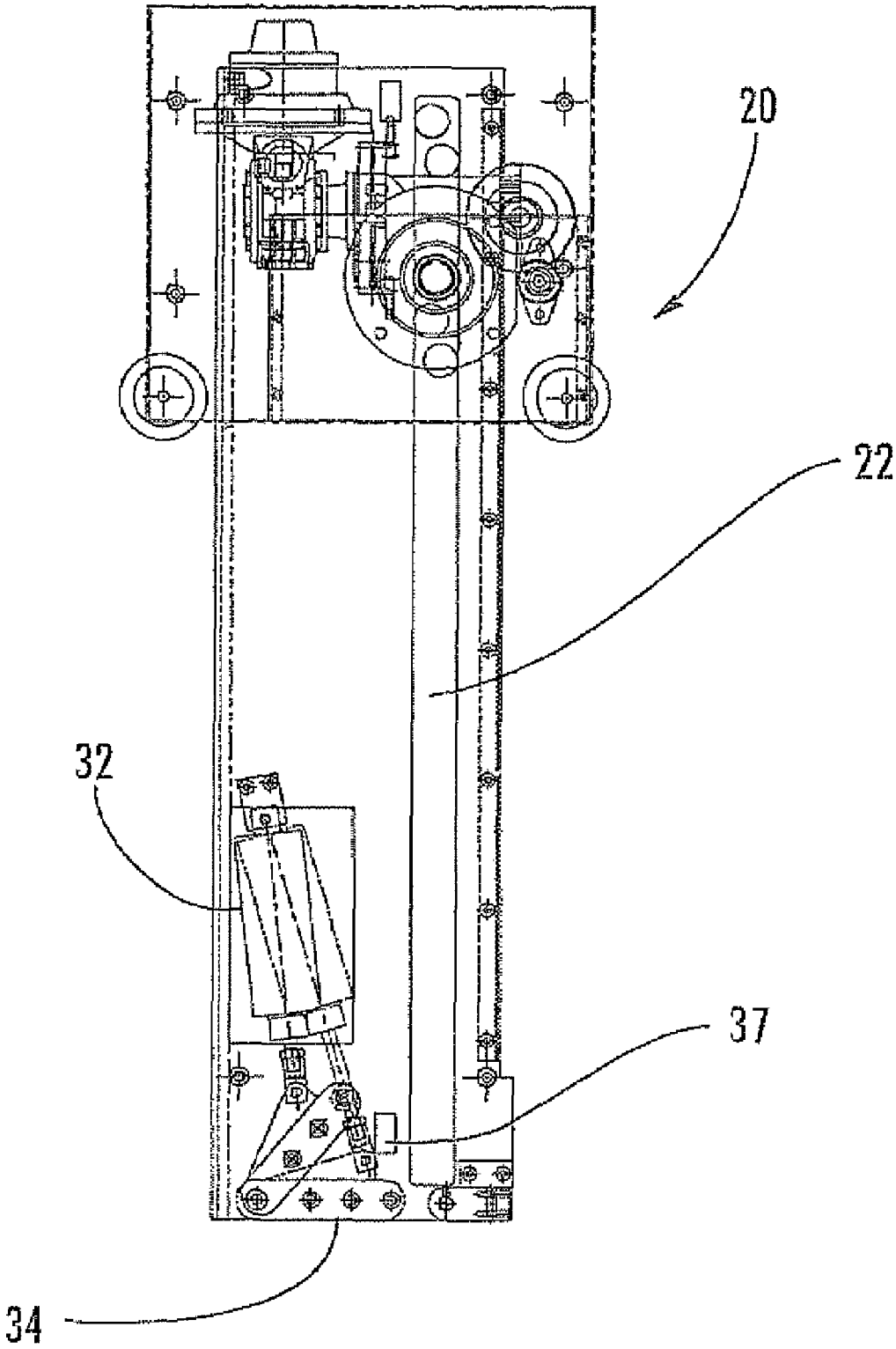
FIG. 5 is a detailed view of the movable nip shaft as shown in FIG. 2.

The wringing device 10 may also include a carriage 20 coupled to the support frame 18. The carriage 20 may be formed from a first side support 22, a second side support 24 positioned generally opposite from the first side support 22, and one or more cross members 26 extending between the first side support 22 and the second side support 24 for support. The carriage 20 may or may not be movable relative to the support frame 18. A nip shaft 28 may be coupled to the carriage 20. The nip shaft 28 may be configured to rotate around a longitudinal axis of the nip shaft 28. A movable nip shaft 30 may be movably coupled to the carriage 20 proximate to the nip shaft 28. The movable nip shaft 30 may extend generally parallel to the nip shaft 28. A biasing device 32, as shown in FIG. 5, may be coupled to the movable nip shaft 30 for biasing the movable nip shaft 30 toward the nip shaft 28. The biasing device 32 may be usable to control the position of a flexible container 14 within the carriage 20. The biasing device 32 may be, but is not limited to, a spring or other appropriate device.

The movable nip shaft 30 may be made movable with a pair of pivot arms 34 pivotably coupled to the first and second side supports 22, 24 of the carriage 20. The movable nip shaft 30 may extend between the pair of pivot arms 34. A lever may extend from either of the pivot arms, or both, to enable the movable nip shaft 30 to be manually moved out of contact with the nip shaft 28. In at least one embodiment, the movable nip shaft 30 may be capable of being rotated from a position in contact with the nip shaft 28 such that an inlet fitment (not shown) in a flexible container 14 may be passed between the nip shaft 28 and the movable nip shaft 30. A distance between the nip shaft 28 and the movable nip shaft 30 may be about four inches in one embodiment to permit passage of the inlet fitment between the shafts 28, 30.

Figure 2:
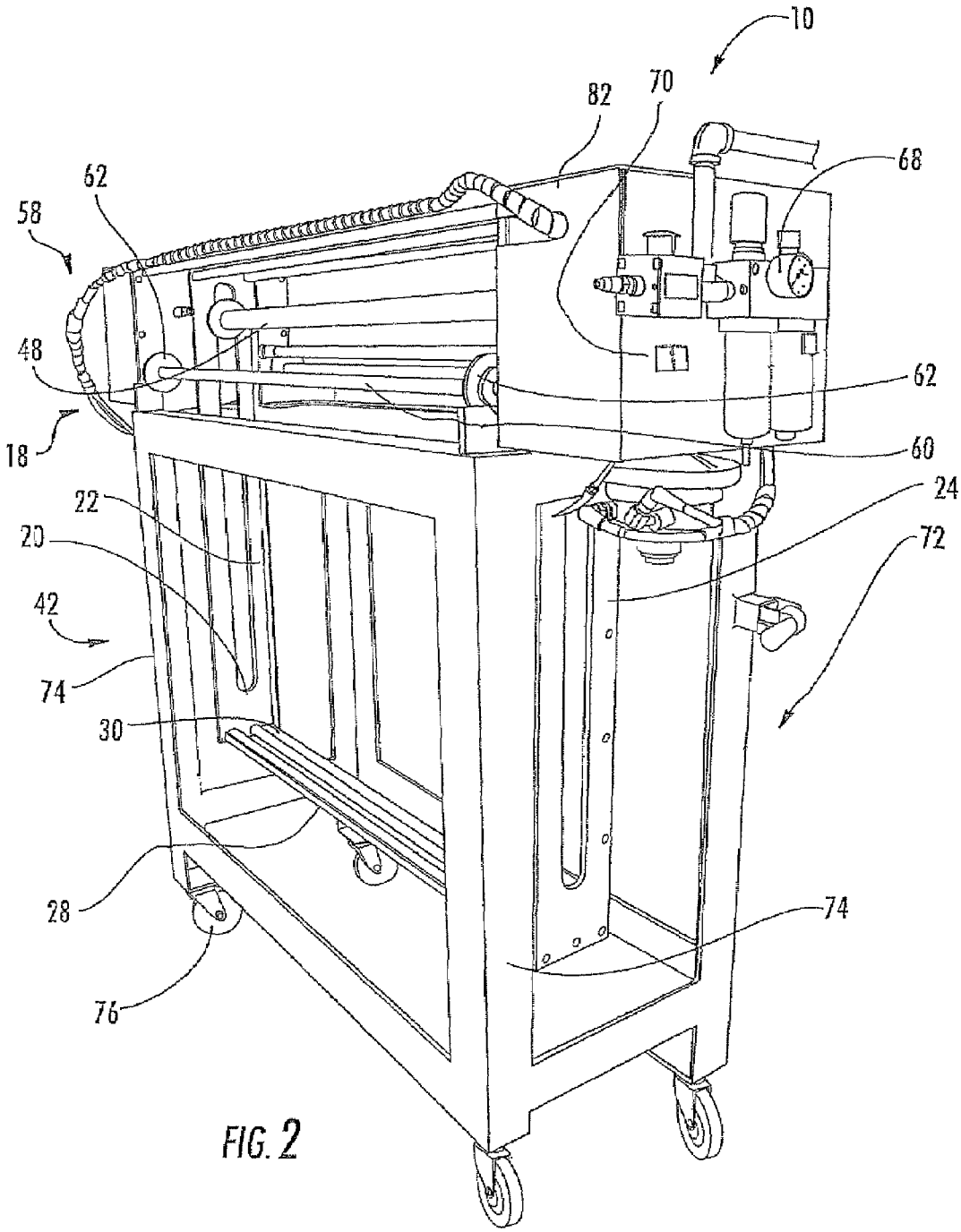
FIG. 2 is a perspective view of the wringing device with the carriage in a lowered position.
Figure 6:
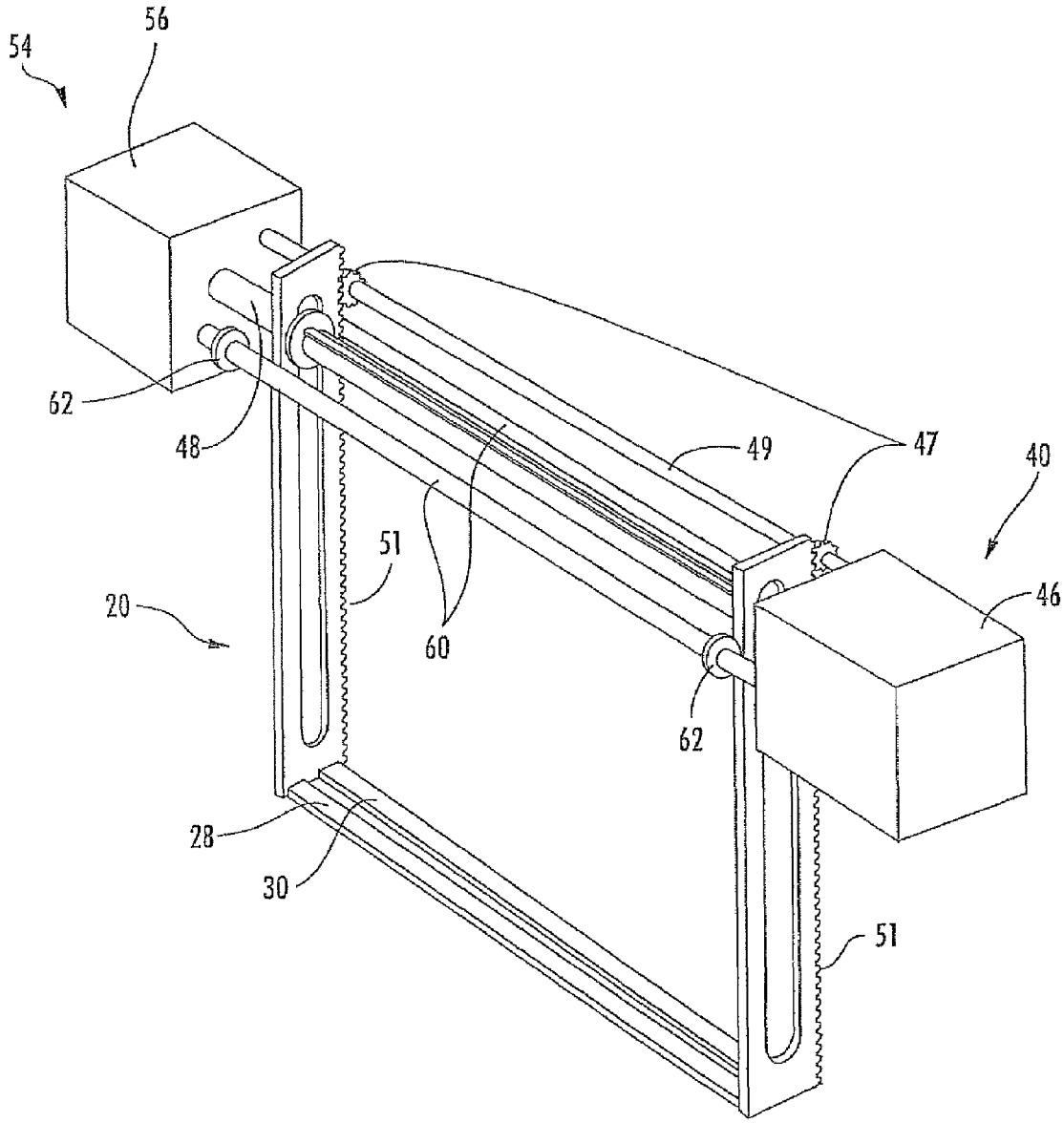
FIG. 6 is a perspective view of the wringing device separate from the carriage.
Figure 7:
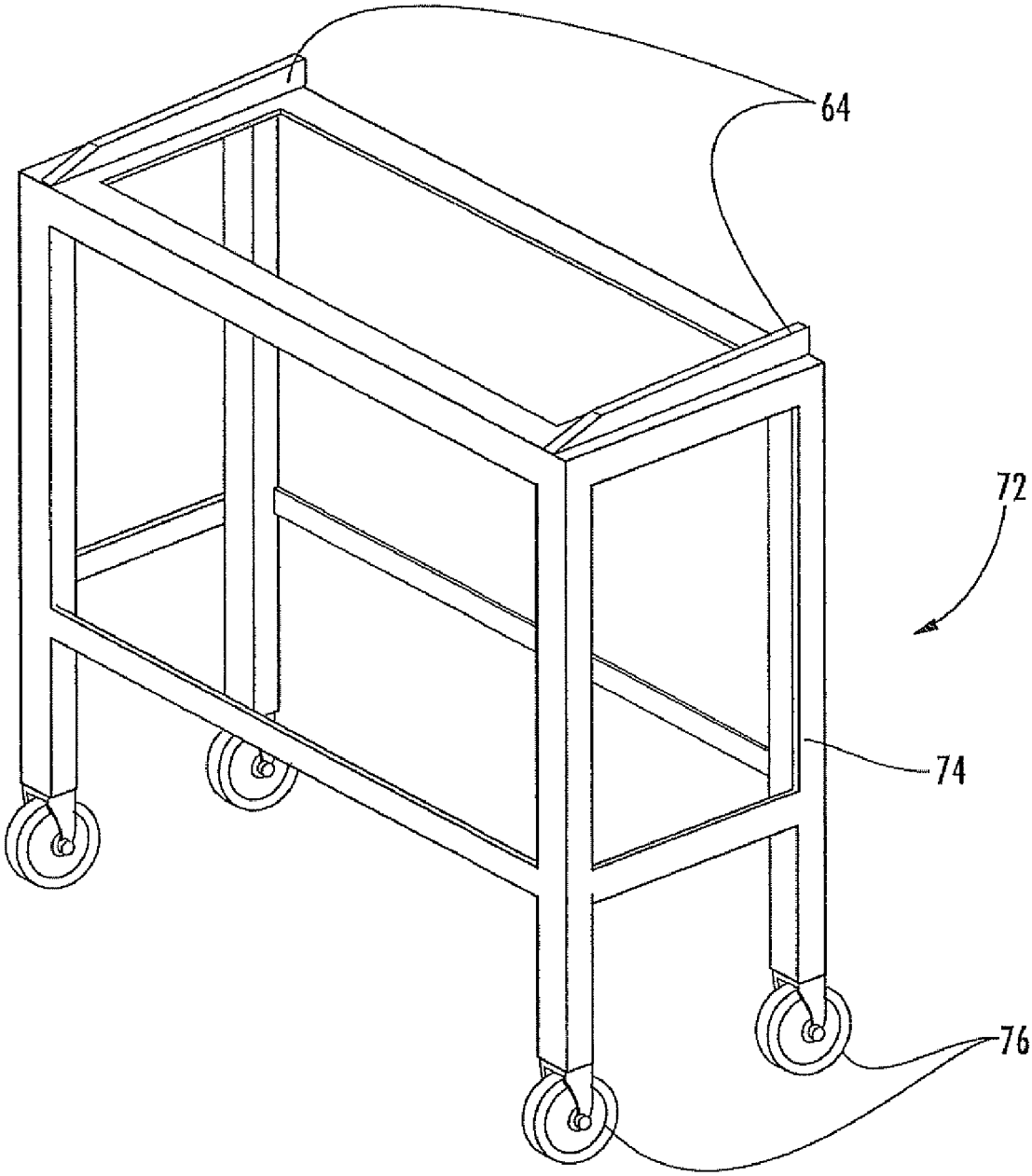
FIG. 7 is a perspective view of the carriage.

As shown in FIG. 6, the wringing device 10 may include a carriage drive device 40 adapted to move the carriage 20 relative to the support frame 18. The carriage drive device 40 may include a drive shaft 49 extending generally from the first side support 22 to the second side support 24. The drive shaft 49 may be in contact with the first side support 22 or the second side support 24, or both. In at least one embodiment, the carriage drive device 40 enables the carriage 20 to be moved generally vertical relative to the support frame 18. The movement of the carriage 20 enables the carriage 20 to be positioned in a lowered transport and operation position 42, as shown in FIG. 2, and positioned in a raised position 44, as shown in FIG. 1. The carriage 20 may be moved manually or mechanically. In at least one embodiment, the carriage drive device 40 may include a drive motor 46 configured to move the carriage 20. The drive motor 46 may be, but is not limited to, a compressed air driven motor 46. The drive motor 46 can drive a plurality of pinions 47 mounted on a drive shaft 49, which drive a rack 51 formed as part of the carriage 20. A sensor 37 may be used to stop the drive motor 46 once the carriage 20 has reached an uppermost or lowermost movement boundary. A stop may be used in embodiments in which the carriage 20 is moved manually.

The wringing device 10, as shown in FIGS. 1-4, may include one or more take-up shafts 48 coupled to the wringing device 10. The take-up shaft 48 may be configured to be rotated around a longitudinal axis of the take-up shaft 48. The take-up shaft 48 may be configured such that a flexible container 14 may be attached to the take-up shaft 48 so that the flexible container 14 may be collected on the take-up shaft 48 by rotating the take-up shaft 48. The take-up shaft 48 may be generally parallel with the nip shaft 28 and the movable nip shaft 30.

The wringing device 10 may include a take-up shaft drive device 54 for driving the take-up shaft 48. The take-up shaft drive device 54 may include a drive motor 56 configured to move the take-up shaft 48. The drive motor 56 may be, but is not limited to, a compressed air driven drive motor 56. The compressed air driven drive motor 56 may be configured such that the motor 56 slips at a predetermined torque to limit or eliminate the risk of ripping open the flexible container 14.

The wringing device 10 may include idler shafts 60 coupled to the motors 46, 56. The idler shafts may be connected to a plurality of wheels 62. The wheels 62 may be formed from materials, such as, but not limited to, DELRIN and other appropriate materials. The wheels 62 may be supported on idler shaft supports 64 provided on a transport vehicle 72.

In at least one embodiment, as shown in FIG. 2, the wringing device 10 may include a drive motor controller 68 adapted to control operation of the carriage drive device 40, the take-up shaft drive device 54, other type drive device that may be associated with the wringing device, or any combination thereof. The drive motor controller 68 may be adapted to receive input and to control operation of the drive devices 40 and 54. In at least one embodiment, the drive motor controller 68 may be a compressed air regulator for controlling operation of the drive devices 40 and 54. In operation, the drive motor controller 68 may individually control the flow air to the carriage drive device 40, the take-up shaft drive device 54, and other type drive device associated with the wringing device. The drive devices 40 and 54 may also be controlled with switches 70. The switches may be, but are not limited to being, momentary on/off switches, or other appropriate switches. A housing 82 may be attached to the support frame 18 to cover the drive motor controller 68 and other related components.

The wringing device 10 may include a transport vehicle 72 usable to transport the support frame 18 and components attached thereto. In at least one embodiment, the transport vehicle 72 may be formed from a frame 74 supported by a plurality of wheels 76 or other devices usable to move the transport vehicle 72 along a ground surface. The frame 74 may be configured such that the support frame 18 and wringing device transport system 58 are positioned at a height enabling the support frame 18 to be moved from the transport vehicle 72 to the upper surface 66 of the bulk container 16, using the wheels 62 on the idler shafts 60, and the supports 64. In at least one embodiment, the frame 74 may be adjustable such that the height at which the support frame 18 is positioned may be adjusted to compensate for bulk containers 16 that have different heights. The transport vehicle 72 enables a support frame 18 to be moved around a warehouse floor between different bulk containers 16 to facilitate unloading of the flexible containers 14.

The wringing device 10 may be used to facilitate delivery of materials from a flexible container 14. The wringing device 10 may be moved into position using the transport vehicle 72. In particular, the wringing device transport system 58 may be placed in alignment with an upper surface 66 of the bulk container 16 so that the support frame 18 of the wringing device 10 may be moved from the transport vehicle 72 to the upper surface 66 of the bulk container 16. The wringing device transport system 58 may be actuated to move the support frame 18 of the wringing device 10 onto the bulk container 16. The motor 46 may be actuated to raise the carriage 20 to a raised position, as shown in FIG. 1. The biasing device 32 may be moved with the lever to separate the movable nip shaft 30 from the nip shaft 28. An upper portion of the flexible container 14 may be fed between the movable nip shaft 30 and the nip shaft 28 and coupled to the take-up shaft 48. The movable nip shaft 30 may then be moved back into position, and in a typical arrangement, the gap between the movable nip shaft 30 and the nip shaft 28 may be about 4", which allows the material of the bag to pass between the nip shafts 28, 30, while preventing a large amount of fluid contained within the flexible container 14 from also passing between the nip shafts 28, 30. The take-up shaft 48 may be activated with the switches 70. A switch 70 may be activate to rotate the take-up shaft 48. The take-up shaft 48 may be rotated with the take-up shaft drive device 54 to wrap the flexible container 14 around the take-up shaft 48. At the same time, or as the operator decides, the motor 46 may be actuated to move the carriage 20 downwardly to the lowered position. As the flexible container 14 is wrapped around the take up shaft 48, and as the carriage 20 is lowered (thus moving the nip shafts 28, 30 downwardly over the flexible container 14), the flexible container 14 passing between the nip shaft 28 and the movable nip shaft 30 undergoes a squeegee action caused by the relatively small gap between the nip shafts 28, 30, thereby causing the material 12 contained within the flexible container 14 to be expelled through one or more fitments.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A method for wringing fluids from a flexible container positioned within a rigid structure using a wringing device positioned over the rigid structure, the wringing device comprising a support frame having a pair of spaced apart side supports, at least one rotatable take-up shaft extending between the pair of spaced apart side supports, and a carriage coupled to the support frame, with the carriage being movable in a generally vertical direction relative to the support frame, the carriage comprising a pair of spaced apart side members, a first nip shaft extending between the pair of spaced apart side members, a second nip shaft adjacent the first nip shaft and also extending between the pair of spaced apart side members, the method comprising:

moving the second nip shaft away from the first nip shaft;

passing the flexible container between the first and second nip shafts;

securing the flexible container to the at least one rotatable take-up shaft;

moving the second nip shaft toward the first nip shaft; and rotating the at least one rotatable take-up shaft for wrapping the flexible container therearound after having passed between the first and second nip shafts so that the fluids are wringed out of the flexible container through at least one opening therein.

2. The method according to claim 1, further comprising biasing the second nip shaft towards the first nip shaft as the flexible container is passed therebetween.

3. The method according to claim 1, wherein the first nip shaft is stationary.

4. The method according to claim 1, wherein the carriage is movable in the generally vertical direction relative to the support frame between a lowered transport position; and a raised operation position, and further comprising moving the carriage to the raised operation position prior to passing the flexible container between the first and second nip shafts.

5. The method according to claim 4, wherein the carriage further comprises a carriage drive device for moving the carriage in the generally vertical direction relative to the support frame.

6. The method according to claim 5, wherein the carriage drive device comprises a drive shaft extending between the pair of spaced apart side members, and a drive motor coupled to the drive shaft.

7. The method according to claim 4, wherein the carriage further comprises a carriage movement limiting device for limiting movement of the carriage relative to the support frame.

8. The method according to claim 1, wherein the rigid structure comprises an intermediate bulk container (IBC).

9. A method for wringing fluids from a flexible container positioned within a rigid structure using a wringing device assembly comprising a wringing device and a transport system for transporting the wringing device, the wringing device comprising a support frame having a pair of spaced apart side supports, at least one rotatable take-up shaft extending between the pair of spaced apart side supports, and a carriage coupled to the support frame, with the carriage being movable in a generally vertical direction relative to the support frame, the carriage comprising a pair of spaced apart side members, a first nip shaft extending between the pair of spaced apart side members, a second nip shaft adjacent the first nip shaft and also extending between the pair of spaced apart side members, the method comprising:

using the transport system for positioning the wringing device over the rigid structure;

moving the second nip shaft away from the first nip shaft;

passing the flexible container between the first and second nip shafts;

securing the flexible container to the at least one rotatable take-up shaft;

moving the second nip shaft toward the first nip shaft; and rotating the at least one rotatable take-up shaft for wrapping the flexible container therearound after having passed between the first and second nip shafts so that the fluids are wringed out of the flexible container through at least one opening therein.

10. The method according to claim 9, further comprising biasing the second nip shaft towards the first nip shaft as the flexible container is passed therebetween.

11. The method according to claim 9, wherein the first nip shaft is stationary.

12. The method according to claim 9, wherein the carriage is movable in the generally vertical direction relative to the support frame between a lowered transport position; and a raised operation position, and further comprising moving the carriage to the raised operation position prior to passing the flexible container between the first and second nip shafts.

13. The method according to claim 12, wherein the carriage further comprises a carriage drive device for moving the carriage in the generally vertical direction relative to the support frame.

14. The method according to claim 13, wherein the carriage drive device comprises a drive shaft extending between the pair of spaced apart side members, and a drive motor coupled to the drive shaft.

15. The method according to claim 13, wherein the carriage further comprises a carriage movement limiting device for limiting movement of the carriage relative to the support frame.

16. The method according to claim 9, wherein the transport system comprises a frame, and a plurality of wheels coupled to the frame.

* * * * *

UNITED STATES PATENT AND TRADEMARK OFFICE

CERTIFICATE OF CORRECTION

PATENT NO. : 7,546,798 B2
APPLICATION NO. : 12/233164
DATED : June 16, 2009
INVENTOR(S) : Naidu et al.

It is certified that error appears in the above-identified patent and that said Letters Patent is hereby corrected as shown below:

| | |
|---|---|
| Abstract Item (57), Line 3 | Delete: "sup ort"<br>Insert: -- support -- |
| Abstract Item (57), Line 10 | Delete: "air"<br>Insert: -- pair -- |
| Column 2, Line 14 | Delete: "may be"<br>Insert: -- may -- |
| Column 2, Line 37 | Delete: "feed"<br>Insert: -- fed -- |
| Column 5, Line 36 | Delete: "activate"<br>Insert: -- activated -- |

Signed and Sealed this

Eighteenth Day of August, 2009

David J. Kappos

David J. Kappos
*Director of the United States Patent and Trademark Office*